US006696213B2

(12) United States Patent
Yamaguchi et al.

(10) Patent No.: US 6,696,213 B2
(45) Date of Patent: Feb. 24, 2004

(54) METHOD OF DEVELOPING A LATENT ELECTROSTATIC IMAGE

(75) Inventors: Kimitoshi Yamaguchi, Numazu (JP); Akihiro Kotsugai, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/091,498

(22) Filed: Mar. 7, 2002

(65) Prior Publication Data

US 2003/0044713 A1 Mar. 6, 2003

(30) Foreign Application Priority Data

Mar. 7, 2001 (JP) ..... P2001-064143
Mar. 1, 2002 (JP) ..... P2002-055668

(51) Int. Cl.[7] ..... G03G 15/09
(52) U.S. Cl. ..... 430/122; 430/111.35; 399/270
(58) Field of Search ..... 430/111.35, 122; 399/270

(56) References Cited

U.S. PATENT DOCUMENTS

| | | | | |
|---|---|---|---|---|
| 4,562,136 | A | 12/1985 | Inoue et al. | |
| 4,590,141 | A | 5/1986 | Aoki et al. | |
| 4,670,368 | A | 6/1987 | Tosaka et al. | |
| 4,950,573 | A | 8/1990 | Yamaguchi et al. | |
| 4,990,425 | A | 2/1991 | Nanya et al. | |
| 5,079,123 | A | 1/1992 | Nanya et al. | |
| 5,085,965 | A | 2/1992 | Nanya et al. | |
| 5,102,766 | A | 4/1992 | Nanya et al. | |
| 5,288,577 | A | 2/1994 | Yamaguchi et al. | |
| 5,368,972 | A | 11/1994 | Yamashita et al. | |
| 5,429,901 | A | 7/1995 | Muto et al. | |
| 6,002,900 | A | * 12/1999 | Ishiyama | 399/149 |
| 6,004,715 | A | 12/1999 | Suzuki et al. | |
| 6,010,814 | A | 1/2000 | Kotsugai et al. | |
| 6,141,521 | A | * 10/2000 | Yuuki et al. | 399/270 |
| 6,160,979 | A | * 12/2000 | Shoji | 399/267 |
| 6,472,118 | B1 | * 10/2002 | Yamaguchi et al. | 430/111.35 |

FOREIGN PATENT DOCUMENTS

EP 0 469 876 A2 2/1992

OTHER PUBLICATIONS

European Search Report for Patent Application 02005038.1 /with Abstract.

* cited by examiner

*Primary Examiner*—John Goodrow
(74) *Attorney, Agent, or Firm*—Oblon, Spivak, McClelland, Maier & Neustadt, P.C.

(57) ABSTRACT

A method of developing a latent electrostatic image using a two-component developer system, having a ratio (Vr/Vp) ranges 1.2<(Vr/Vp)<3 where the (Vp) is a linear speed (Vp)[m/sec] of a photosensitive member and the (Vr) is a linear speed (Vr) [m/sec] of a developing sleeve, and applying a biased direct-current ($V_B$) [by volt] wherein; a developing gap(Gp)[cm] as a distance at the nearest point between a photosensitive member and a developing sleeve is less than or equal to 0.6 mm, a ratio(ρp/ρa) satisfies an expression (ρp/ρa)<0.7 where the ρp is a density[g/cm$^3$] of a developer at the nearest point between a photosensitive member and a developing sleeve, which is represented by an equation ρp=J/Gp where J is an amount of developer scooped up (the ρp is also expressed as "the density of the developer" or "the density of GP agent" in the specification) and the ρa is a bulk density[g/cm$^3$ ] of the developer, a carrier for electrophotography is used, the carrier made of a carrier core particles having a weight average particle diameter(Dv) ranging from 25 μm to 45 μm, the particles of smaller than 44 μm are more than or equal to 70 percent by weight, the particles of smaller than 22 μm are less than or equal to 7 percent by weight, a ratio (Dv/Dp) between the weight average particle diameter (Dv )and the number average particle diameter(Dp) satisfies an expression 1≦(Dv/Dp)≦1.30, the core particles are used by coated form with a resin material. The method is provided for eliminating undesired artifacts in the developed image derived from to the developing direction (where the traveling speed of the developing sleeve is faster than that of the latent electrostatic image).

10 Claims, 1 Drawing Sheet

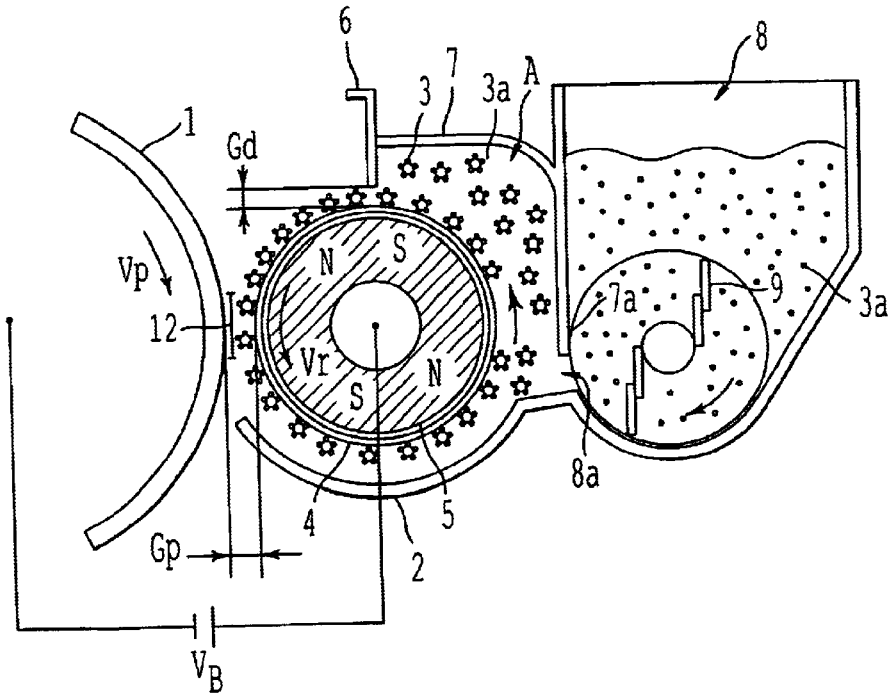
6
7
3
3a
A
8
1
Gd
Vp
12
N
S
Vr
S
N
7a
9
3a
8a
4
5
2
Gp
$V_B$

METHOD OF DEVELOPING A LATENT ELECTROSTATIC IMAGE

DETAILED DESCRIPTION OF THE INVENTION

1. Field of the Invention

The present invention relates to a method of developing a latent electrostatic image used for the electrophotography, the electrostatic recording, and the electrostatic printing.

2. Background of the Invention

Methods of electrophotographic development are divided into two groups, namely, so called a one-component developer method using toner as the main component and a two-component developer method using a mixture of toner and carrier such as glass beads, magnetic carrier, or their coated with a resin As two-component developer method relies on the use of carrier for increasing the charged area for the toner, they are more stable in the charging properties than the most one-component developer method and thus favorable for ensuring the reproduction of high quality images in a long-run operation. Also, the two-component developer method is high in the toner feeding capability to a developing area and can hence be incorporated into high-speed apparatuses.

Such a two-component developer method is commonly employed in the digital electrophotography where a latent electrostatic image is printed on a photosensitive member with laser beam or the like and developed to a visible image.

Also, to cope with the decrease in size of the minimum unit area (a dot or pixel) of latent image while the increase in the density for improving the resolution, the reproducibility of highlight, and the color quality, various modifications of the method have been proposed with respect to processing conditions and developers (toner and carrier).

With regard to the two-component developer methods, in the during development, where assuming the traveling speed (mm/sec) of photosensitive member is Vp (sec) and the width of the image development area (the contacted width of the photosensitive member with the developer) is L (mm), a period of the time during a latent image being held in direct contact with a developer (=a developing period) is represented by An expression L/Vp (sec), if the L is smaller and the Vp is bigger, the developing period becomes shorter. And this shorten developing time declines the degree of development, thus causing undesired decrease of image density, non-uniform density in half toned image, making trace mark of developing brush, causing cutoffs in fine lines in image, forming white voids(blanks) of small size of dots in image and the like, thus deteriorating the quality of reproduced image.

For eliminating above mentioned drawbacks, a technique was introduced which included, for example, means for elevating the electric voltage of the photosensitive member to re the developing electric-potential and means for increasing traveling speed Vr mm/sec) of a developing sleeve so as to coincide with traveling speed Vp (sec/mm) of a photosensitive member moving in the same direction to bring in the more amount of developer to expand the contacting area of the developer with the latent electrostatic image. The rise of developing electric-potential of the photosensitive member is however suffered from an abundant electric charge passing through thereto, thus causing shortening of the life of the photosensitive member, therefore generally adopted means for overcoming the problem are those for increasing the amount of developer to be contacted.

Although an increased amount of developer to be contact by mean of using a difference between rotation speeds of developing sleeve and photosensitive member results in general a higher density of solid image, however the change in optical density and the occurrence of white voids are also very noticeable, especially at edge regions of solid image area and half toned image area. Such phenomenon appears at the area where the latent electric potential is varied sharply and discontinuously.

When the value of the Vr/Vp is greater than 1 with the photosensitive member rotating in the same direction as of the developing sleeve (referred to as forward rotation hereinafter), the carrier is traveling so as to outrun the latent electrostatic image which is also traveling.

Accordingly, at boundary region where the latent electrostatic image varies from background part to image part, developer arrives the background part before it enters into the solid part of image, thereby the toner particles held in carriers remain shifted (repelled) to the developing sleeve at the side opposite to the background part of the latent electrostatic image, by the effect of an electric potential equal to $V_B-V_D$, (where the $V_B$is the biased direct-current and the $V_D$ is the charge potential).

Therefore, when the Vr/Vp is considerably greater than 1, the developer may fail to rapidly feed toner particles to the boundary between the background region and the solid image region, thus generating a white voids(blanks) in the trailing end (rear end of the latent image advancing forward) of the solid region.

During the developer is passing through the background region, its toner particles remain shifted to the sleeve side and less contacted to the photosensitive member. It may say additionally that this phenomenon (shifting of toner particles to tile sleeve side) will contribute to the protection from smears of the background.

As developer arrives from the background region to the trailing end of an image region, the developing area is now going to transfer the toner particles to the latent image for developing it by the effect of a developing potential ($V_L-V_B$, where the $V_L$ is the post-exposure potential and the $V_B$ is the biased direct-current potential), however on the time, the toner particles may hardly be supplied to be transferred, because they having been drifted to the sleeve side.

As a result, a more number of white voids will appear at trailing end of the halftone image area than at trailing end of the solid image area This can be explained by the developing electric-potential is a lower level at the half-tone region. It is now noted that the white voids(blanks) in the solid image are referred to as solid trailing end blanks and the white voids in the half-tone image are referred to as half-tone trailing end blanks hereinafter.

When the photosensitive member and the developing sleeve rotate in opposite directions (referred to as reverse rotation hereinafter), the foregoing phenomena may create blanks at the boundary between a background region and a solid region. The reverse rotation, unlike the forward rotation, permits the blanks in the leading end of the solid image.

Also, when Vr/Vp is smaller than 1 with the forward rotation, the carrier moves towards the latent electrostatic image hence generating a state resemble to the reverse rotation state and causing the blanks to appear in the leading end of the solid image.

For eliminating declinations in the image quality derived from the difference of the developing direction, some attempts were proposed which minimize the difference in the speed between the photosensitive member and the developing sleeve, however they were hard to give success. When the difference in the speeds is minimized, the image density may be declined or the smears of the background area may be generated. It is hence unsuccessful to provide a two-component developer method which can satisfy the both requirements of eliminating blanks and smears.

While digital technologies have been significantly developed for improving the image quality in recent years, the drawbacks pertinent to the developing direction(where the traveling speed of the developing sleeve is faster than that of the latent electrostatic image) may include not only the trailing end blanks in the developed image but also cutouts of the horizontal line, thickening of the vertical line, fault in the sharpness of characters (thickened in the vertical and thinned in the horizontal), and carrier deposition. It is hence desired to provide a further improvement of the method.

Problems that the Invention is to Solve

It is An object of the present invention to provide a developing method which can eliminate any undesired artifacts in the developed image derived from the developing direction(where the traveling speed of the developing sleeve is faster than that of the latent electrostatic image).

More specifically, the object of the present invention is to dissolve the undesired artifacts to be eliminated for developing a high-density image, which artifacts are: 1. trailing end blank; 2. cutout in the horizontal line; 3. thickening of the vertical line; 4. fault in the sharpness of characters (thickened in the vertical and thinned in the horizontal); 5. carrier deposition; and 6. smear of the background.

Means for Solving the Problems

We, the inventors, have found through perpetual experiments the following aspects for achievement of the above and other objects.

1. With regard to trailing end blank and,
2. cutouts in the horizontal line

The above two undesired artifacts result from the fi t that the toner particles are drifted from the photosensitive member to the developing sleeve during the developing processing by the effect of an electric potential equal to $V_B-V_D$ (where the $V_B$ is the biased direct-current and the $V_D$ is the charge potential) and thus decreasing the amount of toners on the surface of the photosensitive member. Also, it results as the toner particles are having been drifted, on the carriers may retain counter charges. When resin coated carrier is used for increasing the operating life of the developer and improving the image quality, it will heavily be affected by the counter charge.

It is hence essential to avoid such toner drift from the carrier surface. Also, desired is an improved developing system which allows the toner particles drifted to be returned back to the carrier surface immediately in response to a shift in the developing electric field.

Although the carrier is decreased in the density to meet with the magnetic brushing effect, it is found that the low-density carrier is not adequate for achievement of the objects. Alternatively, the carrier is attempted to decrease its bulk density relative to the real density for minimizing the concentration of the carrier in the mixture on a magnetic brush in the development stage. It is found that when the density of the GP agent is set to a particular rate, the distance between the carrier particles in the magnetic brush becomes favorable to enhance the movement (dispersion) of the carrier and thus discourage the drifting of the toner particles. More specifically, the crucial requirements for allowing the toner particles to be promptly transferred to the developing surface are realized by both determination of the adequate distance between the carrier particles and establishment of the easy movement of the carrier.

This allows the magnetic brush to avoid in thickened state, unlike that of the prior art, and hardly disturb the movement of the toner particles. Thus movement of the toner particles is significantly improved in the depth direction of the developer. It is also ascertained that the toner particles when drifted are readily effected by the developing potential thus to contribute to the development creating no printing smears in the solid image at the trailing end and the halftone image at the training end.

As the density of the developer is appropriated, its toner particles once deposited may scarcely be scraped off (scavenged) in both the solid and halftone images at the trailing end.

It is furthermore found through the experiments that when the carrier particles are arranged of a smaller diameter with the density of the GP agent set to a desired rate, their surface area becomes increased and permits the toner particles to be sufficiently charged to minimize the production of low charged or reverse charged particles and increase the margin for smear of the background, thus controlling the average charge of each toner particle to a low level, enriching the image density, and improving the image quality in relation to the developing direction. Also, the carrier with a smaller diameter permits the magnetic brush to be thick at the head and smooth in the movement hence creating less brushing traces.

Since the small diameter carrier of the prior art is low in the margin for carrier deposition, it may produce scratched trace on the photosensitive member or the firing roll thus actual use is difficult. It is found that when the carrier particles exhibit a specific pattern of diameters distribution, the drawbacks pertinent to the developing direction and the carrier deposition can simultaneously be eliminated.

3. With regard to thickening of Vertical Line

The vertical line may be thickened by the toner particles received from the (sleeve lengthwise) direction perpendicular to the traveling direction of the developing sleeve.

It is found that when the density of the GP agent is decreased in the developing area, the magnetic brush can be thinned to decline the feed of the toner particles from the horizontal direction at the proximity of the vertical line thus significantly inhibiting the thickening of the vertical line. As the carrier particle diameter is also small, the magnetic brush becomes uniform and relatively thick hence contributing to the inhibition of the thickening and undulation of the vertical lines.

4. With regard to the sharpness of character (thickened in vertical lines and thinned in horizontal lines)

Each character consists of more or less of horizontal and vertical lines and its sharpness (thickened in vertical lines and thinned in horizontal lines) depends on a combination of the three artifacts denoted in the above items 1, 2, and 3.

When the three artifacts are balanced, the sharpness can be improved with the carrier reduced in the particle size.

5. With regard to the carrier deposition

In the developing process of a stationary magnet type, the developer (toner and carrier) is equally oriented to the photosensitive member at the developing area. Therefore, as the developer arrives from a background region to a solid region of the latent image, it is effected by the an electric potential equal to $V_B-V_D$ until entering into the solid region. The toner particles in the developer are biased to the developing sleeve and held less at the top of the magnetic brush, thus the carriers positioned in this head are charged at the reverse polarity. This causes the carrier deposition in a specific area such as the edge of a solid image where the electric field is reversed. When heavily effected by the potential of background area, the developer may gradually be drifted towards the developing sleeve. Upon departing from the developing area, the developer is charged (or counter-charged) at the polarity opposite to that of the toner. As a result, the carrier stays free from the force of magnetic flu: and may be deposited to the photosensitive member (as similar to development).

In a type of simultaneous rotations of both magnet and sleeve, as the carrier is continuously rotated at the developing area and toner does not liberalize from carrier, thereby on the carrier, counter charge to charge of toner is not resulted. As the carrier is substantially charged at no reverse polarity thus to create less white voids (blanks) in the half-tone image at the trailing end, the reproductive of horizontal lines can be improved. It may be estimated from the action of carrier-deposition mechanism that the toner particles on the carrier are not drifted to the developing sleeve but readily transferred to the latent image (thus allowing no delay in the developing process).

It is however necessary in the simultaneous magnet/sleeve rotation type to rotate the magnet at a high speed in response to the linear speed of the developing sleeve and the overall arrangement of the developing system will be complicated. For allowing the magnetic brush to come uniformly into direct contact with the photosensitive member, the magnet has to pass at least two or more polarities dug the latent image is positioned at the developing area. Even if the magnet has some dozen poles 7 the rotation at a speed higher than 1000 rpm win be needed This may generate mechanical vibrations, jitters, and heating up of the sleeve by eddy current, thus declining the quality of the developer and discouraging the achievement of the objects.

The present invention appropriates the magnetic brush density, the carrier particle diameter, and the magnetic properties at the developing area to decline carrier deposition. The higher the charge, the higher the counter-charge becomes. Accordingly, the toner charge per mass has to be determined to an appropriate level.

As described, the artifact by the developing direction can be overcome by appropriating the density of the GP agent and the carrier particle size. As the carrier has a desired pattern of particle size distribution, the margin for carrier deposition can be improved.

6. With regard to the achievement of less smear at background with improved the image density Heretofore, if the amount of scooped up feed is sharply decreased, the optical density of image as well as the margin for smear of the background may be declined. It is found that the developing efficiency of the toner in the developer is significantly increased by controllably determining the density of the GP agent to a desired level and simultaneously, using the carrier having increased surface area and an unique pattern of particle diameters distribution. Accordingly; the developing method having a constitution specified below can be fee from both the undesired artifacts of smear of the background and of the developing direction Namely, based on the foregoing aspects and results of analysis, the abovementioned and other objects of the present invention are achieved by the of methods according to the present invention featuring as denoted below:

(1) A method of developing a latent electrostatic image using a two-component developer system, having a ratio (Vr/Vp) ranges $1.2<(Vr/Vp)<3$ where the (Vp) is a linear speed (Vp)[m/sec] of a photosensitive member and the (Vr) is a linear speed (Vr) [m/sec] of a developing sleeve, and applying a biased direct-current ($V_B$) [by volt], wherein; a developing gap(Gp)[cm] as a distance at the nearest point between a photosensitive member and a developing sleeve is less than or equal to 0.6 mm, a ratio($\rho p/\rho a$) satisfies an expression ($\rho p/\rho a$) $<0.7$ where the ($\rho p$) is a density[g $cm^3$] of a developer at the nearest point between a photosensitive member and a developing sleeve, which is represented by an equation $\rho p=J/Gp$ where J is an amount of developer scooped up (the ($\rho p$) is also described as "the density of the developer" or "the density of GP agent" in the specification) and the ($\rho a$) is a bulk density[g/$cm^3$] of the developer, a carrier for electrophotography is used, the carrier is made of a carrier core particles having a weight average particle diameter(Dv) ranging from 25 $\mu$m to 45 $\mu$m, the particles of smaller than 44 $\mu$m are more than or equal to 70 percent by weight, the particles of smaller than 22 $\mu$m are less than or equal to 7 percent by weight, a ratio (Dv/Dp) between the weight average particle diameter (Dv )and the number average particle diameter(Dp) satisfies an expression $1\leqq(Dv/Dp)\leqq1.30$, the core particles are used by coated form with a resin material:

(2) A method of developing a latent electrostatic image using a two-component developer system according to paragraph (1), wherein; the core carriers have a magnetic moment (at one K Oe=1000 Oe) ranging 60 to 100 emu/g.

(3) A method of developing a latent electrostatic image using a two-component developer system according to paragraphs (1) or (2), wherein; a developing potential less than or equal to 350 volts is applied where the developing potential is defined by an expression ($V_L-V_B$) while the $V_L$ is a post-exposure potential and the $V_B$ is a biased direct-current potential;

(4) A method of developing a latent electrostatic image using a two-component developer system according to any one paragraph consisting of group of paragraphs (1) to (3), wherein; a potential (equal to $V_B-V_D$) of background area is less than or equal to 250 volts where the potential of background area defined by an expression $V_B-V_D$ while the $V_B$ is a biased direct-current potential and the $V_D$ is a charged potential.

The density ($\rho p$) of the GP agent is equal to J/Gp (G/$cm^3$) while Gp can be measured with the use of a thickness gage, laser beam, or the like.

The four features of the present invention for improvement abovementioned items of artifacts 1 to 6 of the developing process will now be described in the form of achieving means.

In the two-component developer system using a biased direct-current ($V_B$) to be applied, as described above, it is essential that the distance (Gp, a developing gap) at the nearest point between the photosensitive member and the developing sleeve is not greater than 0.6 mm and established ratio is ($\rho p/\rho a$)$<0.7$ when $\rho p$ is the density of the developer at the nearest point and $\rho a$ is the bulk density of the developer. Also, the electronic photography carrier is used which is made of carrier cores having a weight average size ranging from 25 $\mu$m to 45 $\mu$m, in which the particles of smaller than 44 $\mu$m are not lower than 70 percent by weight and the particles of smaller than 22 $\mu$m are not higher than 7 percent by weight and the ratio between the weight average particle diameter Dv and the number average particle diameter Dp is $1 \leqq (Dv/Dp) \leqq 1.30$, the carrier are coated with a resin material; wherein;

ρp =J/Gp[g/cm$^2$] (referred to as the density of the developer or the density of GP agent hereinafter)

Gp=developing gap[cm]

J=amount scooped up feed[g/cm$^2$]

ρa=bulk density of the developer[g/cm $^3$]

Vr=linear speed of developing sleeve [m/sec]

Vp=linear speed of photosensitive member [m/sec]

$V_B$=biased direct-current[volt]

Dv=weight average particle diameter[μm]

Dp=number average particle diameter [μm].

This method is a reverse of the prior art which intends to feed a large amount of the developer to the developing area for increasing the image density and avoiding undesired white voids(blanks) in the developed image.

Favorable range of the developing gap( Gp ) is less than or equal to 0.6 mm, more preferably less than or equal to 0.5 mm. When exceeding 0.6 mm, high enough optical density of image is hardly obtained, high excess density at periphery of solid image(namely strongly edge-effected image) and deposition of carriers near fringe of solid image are may conducted.

The scooped up feed J (g/cm$^2$) is a density expressed by grams per square centimeter, of the developer amount given by stirring for 60 seconds in the developing sleeve run at a given processing speed then forcibly stopping the movement of the system so as make the developer passed through to a doctor blade and stayed at an area before fed into the developing area.

The (ρp/ρa) is a ratio of density( ρp ) of developer or GP agent against for bulk density( ρa )of the developer used, and is an indicator showing filling degree of developer at developing area. The (ρp/ρa) is density/density, therefore has the unit of no dimension. When the (ρp/ρa) is small, there are provided many spaces between carrier particles at developing area, thereby movement of toners are not impeded, thus causing a conscientious adhesion of toners for latent image. On the other hand, the larger (ρp/ρa) results the lesser space, therefore toners located at developing sleeve side distant from latent image are impeded for the movement by the dense magnet blush, thus causing a not conscientious adhesion of toners for latent image, while significant white voids or blanks at trailing end of trailing end of the solid image area and at trailing end of the halftone image area Thus the reason why the (ρp/ρa) value has to be smaller than 0.7 in accordance to the present invention is relied on a purpose for improving white voids or blanks at trailing end of trailing end of the solid image area, white voids or blanks at trailing end of the halftone image area, and sharpness of image. On the other hand, the smaller (ρp/ρa) makes the lower optical density of the image. The lowering in optical density of the image may compensate by increase of linear speed of developing sleeve, however it also gives bigger centrifugal effect to the developer, thereby increasing a of toners, making apparatus dirty and spurring background significantly, accordingly, the linear speed of developing sleeve can not increase extremely. Another, the optical density of the image can be enhanced by elevating the developing electric-potential. However, the elevation of the developing electric-potential also causes an intensified electric field at periphery of solid image(namely strongly edge-effected electric field ), thereby effecting unfavorable white voids or blanks at trailing end of the solid image area, deposition of carriers near fringe of solid image.

Accordingly, upon consideration of development conditions for yielding a high quality image, although the lower limit of the (ρp/ρa) value is hard to decide facilely, however in the range of less than 3.5 in near speed of developing sleeve with less than 450 volts in developing electric-potential, more than 0.25 of the (ρp/ρa) value is favorable, and more than 0.30 of the (ρp/ρa) value is more favorable.

Using a bulk specific weight meter conforming to JIS-Z2504, the bulk density (ρa) of the developer is calculated by filling a 25-cm$^3$ stainless steel cup with 85±5 g of the developer, removing an overflow of the developer with a flat stainless steel strip of 10 mm wide, and dividing the weight of the developer in the cut by 25 cm$^3$.

The bulk density of the developer herein means the average toner concentration in the developer during the running action under given processing conditions.

The linear speed ratio (Vr/Vp) between the speed (Vp) of the photosensitive member and the speed (Vr) of the developing sleeve is preferably $1<(Vr/Vp)<3.5$ and more preferably $1.2<(Vr/Vp)<3$, where the Vr is the linear speed of the developing sleeve measured in m/sec and the Vp is the linear speed of the photosensitive member measured in m/sec. If the linear speed ratio (Vr/Vp) is less than 1, the amount of developer passing through latent image is decreased, therefore enough optical density is hardly obtained, and the cleaning effect in background area by magnet blush becomes few, therefore is likely to make background dirty. On the other hand, when more than or equal to 3.5, high optical density may obtain, but frying of toners moreover frying developers are increased, due to a strengthened centrifugal force for toners and developers, thus making apparatus dirty and smearing background significantly.

BRIEF DESCRIPTION OF THE DRAWINGS

FIG. 1 shows an example of a developing apparatus used in, but not limit for the present invention.

The apparatus includes a developer-supply room (A), which is as a container (2) for a developing sleeve (4) and being positioned at a developing gap (Gp) between surfaces of a photosensitive drum (1) and the developing sleeve (4) in concerned with a developing area (12) and having therein a magnet roller (5), a developer (3) including a toner **(3*a*), a doctor (6) for developer defining a doctor gap(Gd), the doctor is also called as a controlling member for a magnetic brush to be formed, a front canopy (7), a partition wall (7*a*) which divides the container (2) and toner hopper (8), an opening (8*a*) for toner supply, a toner-supply roller (9)**.

The photosensitive drum (1) rotates along with arrow mark (Vd), and has a surface-protective layer containing filler, and forms thereto a latent eletricstatic image using a charger and exposing means. The magnet roller (5) is settled in the developing sleeve (4) as a developer-carrier, and has a plural of N pores and S pores periphery, the developer (3) is cared by the developing sleeve (4) and the magnet roller (5), while the developing sleeve (4) rotates in relation with the settled magnet roller (5) to the same direction as that of the rotation of photosensitive drum (1). As the N pores and S pores of the magnet roller (5) are magnetized to a proper magnetic flux density, its magnetic moment forms a magnetic blush consisting of developer, the doctor (6) for developer as a controlling member controls the height and amount of the magnetic brush to be formed by the doctor gap (Gd).

The toner supplied in the apparatus is tribo-electronically charged in a miring with carrier effected by the rotation of supply-roller (9), then transported to the container (2) for a developing sleeve (4) to thereon form a magnetic brush having a controlled amount and height. The distance between the surfaces of photosensitive drum (1) and the developing sleeve (4) is adjusted to form a defined gap (Gp). And during development of the latent electrostatic image, the magnetic brush formed on the surface of the developing sleeve (4) is transported by accompanied with the rotation of the developing sleeve (4) and with a oscillating in concordance with the shift of magnetic flux density caused by the rotation of the developing sleeve (4), passing through the gap at developing area (12), thereby the latent static image is developed by toner therein. On the time, for the sake of a favorable development, a viassed voltage (Vb) is generally applied between the the developing sleeve (4) and the photosensitive drum (1).

Abovementioned particle diameter of the carrier may be measured using a Micro-Track particle analyzer (made by Leeds & Northrup) as calculated from:

Weight average particle diameter$=Dv=\{1/\Sigma(nd^3)\}\times\{\Sigma$(total sum of volumes of particles in $k$ channels)×mean particle diameter in $k$ channels$\}$ (Equation 1)

Number average particle diameter$=Dp=$(1/total number of particles)$\times\{\Sigma$(number of particles in $k$ channels)×mean particle diameter in $k$ channels$\}$ (Equation 2)

When the weight average particle diameter is large, carrier deposition will successfully be inhibited. When the toner density is increased for improving the image density, smear of the background may significantly appear. It is found from measuring the diameter of the small-sized carrier particles which remain deposited that most of the particles are small than 22 $\mu$m in the diameter.

The carrier particles having a weight average diameter of 25 to 45 $\mu$m are then examined for depositability through varying the weight ratio of the particles of smaller than or equal to 22 $\mu$m in the diameter in the carrier. No deposition trouble is found when the content of particles of smaller than or equal to 22 $\mu$m in the diameter is not greater than 7 percent by weight. It is also found that when the content of particles of smaller than 44 $\mu$m in the diameter is greater than or equal to 70 percent by weight and the ratio is $1\leqq(Dv/Dp)\leqq1.30$, the reproducibility of dots as well as the inhibition of carrier deposition can be improved thus increasing the optical density of image.

Moreover, when the density of the GP agent is appropriated and the carrier having the particle diameters and a desired pattern of size distribution as described, no smear of the background will appear with the image density remaining high. Simultaneously it is found that undesired artifacts pertinent to the direction of the developing can remarkably be eliminated thus enhancing the quality of the developed image.

Also, the carrier core of abovementioned particle size distribution favorably has a magnetic moment (at one KOe) ranging preference from 40 to 130 emu/g and more preferably from 60 to 100 emu/g.

The magnetic moment is measured at a magnetic field of 1000 Oe with a multi-specimen rotary type magnetization sensor, REM-1-10, made by Toei Kogyo.

As the magnetic moment of the carrier is decreased to smaller than 40 emu/g, the carrier particles on the magnetic brush are spread out by the action of a centrifugal force thus causing carrier deposition. Also, as the carrier of counter charged is developed over the edge of a solid image or the background area under an electric field reverse polarity to that of latent image, carrier deposition may appear on the photosensitive member. On the other hand, if magnetic moment is larger than 130 emu/g, magnetic blush formed by developer becomes solid and thick, therefore trace mark thereby becomes harsh.

The carrier core according to the present invention may be selected from a variety of known materials.

Characteristic examples of the core material are ferromagnetic materials such as iron or cobalt, hematite, and various metal oxides including magnetite and ferrite expressed as $MOFe_2O_3$ or $MFe_2O_4$ where M is a bivalent or monovalent metal ion selected from Mn, Fe, Ni, Co, Cu, Mg, Zn, Cd, Li, and the like. The M may be used as solitary or in a combination More specific examples are Li ferrite, Mn ferrite, Mn—Zn ferrite, Cu—Zn ferrite, Ni—Zn ferrite, and Ba ferrite.

While the carrier core is commonly made of the magnetic particle material as described above, the carrier may be provided in a resin-dispersed form having a power of the magnetic material dispersed into a known resin material.

In the case of development method defined in above paragraph (1), as the toner particles are highly movable to offer a favorable efficiency of the developing process, therefore can improve the image density and minimize undesired artifacts pertinent to the developing direction at the developing electric-potential of not higher than 350 volts where developing potential$=V_L-V_B$ (the $V_L$, is the post-exposure potential and the $V_B$ is the biased direct-current potential), thus producing high quality of the image developed.

As the developing electric-potential is minimized, the charged level can be declined thus retarding the deterioration of the photosensitive member.

In the method defined in above paragraph (1), as the margin for smear of the background is high enough, a lowered electric-potential may be applied to the background area. The electric-potential of background area (equal to $V_B-V_D$) may be not higher than 250 volts. As the electric-potential of background area is minimized, the charged level can be decreased thus retarding the deterioration of the photosensitive member.

Herein, electric-potential$=V_B-V_D$ where the $V_B$ is the biased direct-current potential and the $V_D$ is the charged potential.

The carrier particle according to the present invention is made of a core coated with a resin material. The resin material may be either a single material or a combination of two or more materials.

Characteristic examples of the resin material are styrene resins including polystyrene, chloro-polystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic acid ester copolymer (styrene-acrylic acid methyl copolymer, styrene-acrylic acid methyl copolymer, styrene-acrylic acid butyl copolymer, styrene-acrylic acid octyl copolymer, and styrene-acrylic acid phenyl copolymer), strene-methacrylic acid ester copolymer (styrene-methacrylic acid methyl copolymer, styrene-methacrylic acid ethyl copolymer, styrene-methacrylic acid butyl copolymer, styrene-methacrylic acid octyl copolymer, and styrene-methacrylic acid phenyl copolymer), styrene-α-chloracrylic acid methyl copolymer, and styrene-acrylonitryl-acrylic acid ester copolymer, epoxy resins, polyester resins, polyethylene resins, polypropylene resins, ionomer resins, polyurethane resins, ketone resins, ethylene-ethyl acrylate copolymer, xylene resins, polyamide resins, straight silicon resins, modified silicone resins, phenol resins, polycarbonate resins, melamine resins, and the like.

The method of coating with the resin material may be instanced the known manners including spray dry method, immersion method, powder coating method, and the like.

The toner according to the present invention comprises mainly a thermoplastic resin as a binder, a coloring agent, extra characteristic particles, a charge controller, and a mold lubricant.

The thickness of resin layer formed onto the surface of carrier particles is, in general, the range from 0.02 to 1.0 $\mu$m, more favorably from 0.03 to 0.8$\mu$m. In case of the thickness less than 0.02 $\mu$m, the resin layer is likely to peel off, and shorten the life by wearing, on the other hand, the thickness exceeding 1.0 $\mu$m causes high electric resistance in carriers, thereby the counter charges retained in carriers after liberating of toners are easily accumulated, thus effecting unfavorable white voids or blanks at trailing end of the solid image area, deposition of carriers near fringe of solid image.

The particles of the toner may be prepared by any known manner such as pulverizing, milling, polymerization, or granulation as arranged of a desired shape or a spherical shape.

The resin binder may be either a single material or a mixture of materials.

Characteristic examples of the acrylic resin binder are styrene resins including polymer of styrene or substituted styrene such as polystyrene or polyvinyl toluene, styrene-p-chlorstyrene copolymer, styrene-propylene copolymer, styrene-vinyl toluene copolymer, styrene-acrylic acid methyl copolymer, styrene-acrylic acid ethyl copolymer, styrene-acrylic acid butyl copolymer, styrene-methacrylic acid methyl copolymer, styrene-methacrylic acid ethyl copolymer, styrene-methacrylic acid butyl copolymer, styrene-$\alpha$-chlormethacrylic acid methyl copolymer, styrene-acrylonitryl copolymer, styrene-vinyl methylether copolymer, styrene-vinyl methylketone copolymer, styrene-isoprene copolymer, styrene-maleic acid copolymer, and styrene-maleic acid ester copolymer, polymethyl methacrylate, polybutyl methacrylate, polyvinyl chloride, polyvinyl acetate, polyethylene, polypropylene, polyester, polyurethane, epoxy resin, polyvinyl buthyral, polyacrylic acid resin, rosin, modefied rosin, terpene resin, phenol resin, aliphatic or cycloaliphatic hydrocarbon resin, aromatic petroleum resin, chlorinated paraffin, and paraffin wax.

The polyester resin is preferably used rather than the acrylic resins in view of the stability in the storage of the toner with lowered viscosity in melted.

The polyester resin may be synthesized by polymerizing condensation of alcohol and acid. The alcohol is selected from bivalent alcohol monomers including a diol such as polyethylene glycol, diethylene glycol, triethylene glycol, 1,2-propylene glycol, 1,3-propylene glycol, 1,4-propylene glycol, neopenthyl glycol, or 1,4-butane diol, an etherized bisphenol such as 1,4-bis (hydroxymethyl) cyclohexane, bisphenol A, hydrogenated bisphenol A, polyoxyethylenized bisphenol A, polyoxypropylenized bisphenol A, substituted single bivalent alcohol and other bivalent alcohol thereof which were substituted with a saturated or unsaturated hydrocarbon group having 3 to 22 carbon atoms, and trivalent or higher alcohol monomers including sorbitol, 1,2,3,6-hexane tetrol, 1,4-sorbitan, pentaerythritol, di-pentaerythritol, tri-pentaerythritol, sucrose, 1,2,4-butane triol, 1,2,5-pentane triol, glycerol, 2-methylpropane triol, 2-methyl-1,2,4-butane triol, trimethylol ethane, trimethylol propane, or 1,3,5-trihydroxy methyl benzene.

The acid used for synthesizing the polyester resin is selected from carbonic acids including mono-carbonic acid such as palmitic acid, stearic acid, or oleic acid, bivalent organic acid monomers including any of maleic acid, fumaric acid, mesaconic acid, citraconic acid, terephthalic acid, cyclohexane dicarbonic acid, succinic acid, adipic acid, sebacic acid, and malonic acid, substituted organic acid thereof which are substituted with a saturated or unsaturated hydrocarbon group having 3 to 22 carbon atoms, anhydride thereof, dimers prepared from lower alkyester and linolenic acid, and polyvalent carbonic acid monomers including 1,2,4-benzene tri-carbonic acid, 1,2,5-benzene tri-carbonic acid, 2,5,7-naphthalene tri-carbonic acid, 1,2,4-naphthalene tricarbonic acid, 1,2,4-butane tri-carbonic acid, 1,2,5-hexane tri-carbonic acid, 1,3-dicarboxyl-2methyl-2-methylenecarboxy propane, tetra(methylenecarboxy) mete, 1,2,7,8-octane tetra-carbonic acid enbol trimer, and anhydride thereof.

The epoxy resin may be a polymerizing condensation product from bisphenol A and epochlor-hydrine such as Epomic R362, R364, R365, R366, R367, or R369 (products of Mitsui Petroleum Chemical), Epototo YD-011, YD-012, YD014, YD-904, or YD-017 (products of Toto Chemical), or Epocoat 1002, 1004, or 1007 (products of Shell Chemical).

The coloring agent according to the present invention is selected from various known dyes and pigments including carbon black, lamp black, iron black, ultramarine blue, Nigrosine dye, Aniline blue, Phthalocyanine blue, Hansa yellow G, Rhodamine 6G, lake, chalcoil blue, Chrome yellow, Qunacridone, Benzidine yellow, rose bengal, tri-aryl methane dye, mono-azo dye, and dis-azo dye which may be used as a single material or a mixture of two or more materials.

For controlling tribo-electric charge, to the toner may be added with a charge controlling agent, such as metal complex of amino compound of mono-azo dye, nitrohumic acid or its salt, salicylic acid, naphtoic acid, or dicarbonic acid, fourth class ammonium compound, or organic dye with a Co, Cr, Fe or the like.

The toner according to the present invention may also be added with a repellant such as mold lubricant.

Characteristic examples of the repellant are, but not limited to, low molecular-weight polypropylene, low molecular-weight polyethylene, carnauba wax, microcrystalline wax, jojoba wax, rice wax, and montan wax which may be used a single substance or a mixture.

It is essential for producing the image with a high quality having no printing blanks to have the toner enhanced in the movability(fluidabilty). This can be implemented by a known manner additionally providing hydrophobic metal oxide particles and the like as the flowability improving agent or lubricant particles. Examples of the metal oxide, the organic resin particles, and the metal soap as the lubricant particles include a lubricant such as polytetrafloroethylenic florine resin or zinc stearate, polishing agent such as cerium oxide or silicon carbide, a flowability stimulator such as $SiO_2$, $TiO_2$, or any other inorganic oxide having surfaces hydrophobic-treated, caking inhibitor, and surfactant. In common, hydrophobic-treated silica may be used best for improving the flowability.

DETAILED DESCRIPTION OF THE PREFERRED EMBODIMENT

EXAMPLES

The present invention will now be described in more detail refer complex ring to some preparations, examples, and Comparative Examples. All parts are by weight throughout the description.

| (Toner Preparation 1) | |
|---|---|
| Polyester resin | 60 parts |
| Styrene acrylic resin | 25 parts |
| Caunauba wax | 5 parts |
| (NX-A-3 as the first number by Caranica Noda Corp Ltd) | |
| Carbon black (#44 by Mitsubishi Chemical) | 9 parts |
| Cr-containing azo-compound (T-77 by Hodogaya Chemical) | 2 parts |

The above materials were mired together by a blender, kneaded in melting form by a two-axis extruder, cooled down, roughly milled by a cutter mill, finely milled by a jet-air mill, and separated by a pneumatic separator to obtain toner plain particles which were 7.6 $\mu$m in the weight average particle diameter and 1.20 g/cm$^3$ in the true specific weight.

To 100 parts of the toner plain particles were then added with 0.8 part of hydrophobic silica particles (R972 made by Nippon Aerosol) and mixed together by a Herschel mixer to prepare a toner I.

(Carrier Preparation 1)

Silicon resin (SR2411 made by Toray Dow-Coring) was diluted so as to contain 5 percent by weight of solid to prepare a silicon resin solution.

The silicon resin solution was applied at a rate of substantially 40 g/min to 5 kg of carrier core material 1 (Cu—Zn ferrite) listed in Table 1 with the use of a fluidized-floor type of coating apparatus under an atmosphere at 100° C. and then heated at 270° C. for two hours to prepare a carrier A which was 0.65 $\mu$m in the coating thickness and 5.0 g/cm$^8$ in the true specific weight. The coating thickness was effected by controlling the amount of the solution for coating.

(Carrier Preparation 2)

The same process as of Carrier Preparation 1 was carried out with the exception of a carrier core material 2 listed in Table 1 was used instead of the carrier in Carrier Preparation 1, to prepare a carrier B which was 0.65 $\mu$m in the coating thickness and 5.0 g/cm$^3$ in the true specific weight.

(Carrier Preparation 3)

The same process as of Carrier Preparation 1 was carried out with the exception of a carrier core material 3 listed in Table 1 was used instead of the carrier in Carrier Preparation 1, to prepare a carrier C which was 0.65 $\mu$m in the coating thickness and 5.0 g/cm$^3$ in the true specific weight.

(Carrier Preparation 4)

The same process as of Carrier Preparation 1 was carried out with the exception of a carrier core material 4 listed in Table 1 was used instead of the carrier in Carrier Preparation 1, to prepare a carrier D which was 0.65 $\mu$m in the coating thickness and 5.0 g/cm$^8$ in the true specific weight.

(Carrier Preparation 5)

The same process as of Carrier Preparation 1 was carried out with the exception of a carrier core material 5 listed in Table 1 was used instead of the carrier in Carrier Preparation 1, to prepare a carrier E which was 80 emu/g in the magnetic moment, 0.65 $\mu$m in the coating thickness and 5.0 g/cm$^8$ in the true specific weight.

(Evaluation)

Developing Conditions

Some images to be evaluated were developed under the following conditions using a copy machine/digital printer, Imagio MF4570, made by Ricoh.

Charged potential (Vd): variable of charging voltage in the scope from zero to negative 1000 volts Developing bias: adjusted appropriate level of DC bias supplied from external source Developing gap (between photosensitive member and developing sleeve): 0.40 mm Diameter of developing sleeve: 20 mm Developing width at developing area (contacted width of the developer with the photosensitive member): about 4.0 mm Scooped up feed: adjusted by the gap between the surface of developing sleeve and end of doctor Linear speed of photosensitive member: 230 mm/sec Ratio of linear speed of developing sleeve/linear speed of photosensitive member: 2.5 (in forward rotating of developing direction)

Electric potential ($V_1$) for latent (solid or half-tone) image printing area: 150 V adjusted by the intensity of laser beam Photosensitive member: 30 $\mu$m thick and 80 PF/cm$^2$ of electrostatic capacitance in charge transferring layer Evaluation; by printed images on paper sheets Items for Evaluation 1. Image density: average of measurements at five different locations of a 30×30 cm solid black area developed under the above conditions and measured by a Macbeth densitometer, purpose of optical density on image is higher than 1.40
2. Smear of the background: smear of the background resulted from the above conditions and classified into ten grades, grade 10 represents the best result.

Evaluation of the background smear was made by counting the number of toner particles attached at background area(non-image area) on transferred paper sheet, calculating a number of attached toner particles/cm$^2$. Relationships between each grade and a number of attached toner particles /cm $^2$are as follow.

grade 10: from 0 to 36 toner particles grade 9: from 37 to 72 toner particles grade 8: from 73 to 108 toner particles grade 7: from 109 to 144 toner particles grade 6: from 145 to 180 toner particles grade 5: from 181 to 216 toner particles grade 4: from 217 to 252 toner particles grade 3: from 253 to 288 toner particles grade 2: from 289 to 324 toner particles grade 1: more than 325 toner particles 3. White voids(blanks) at solid area of tailing end: degree of blank (in width) at the trailing end of a 3 ×30cm solid black area (negative 150 V of optical potential of latent image) resulted from the above conditions, relationships between each grade and width of white voids are as follow, grade 10 representing the best result.

grade 10: no trace of white void grade 9: less than 0.mm wide of white void grade 8: from 0.1 to 0.2 mm wide of white void grade 7: from 0.2 to 0.4 mm wide of white void grade 6: from 0.4 to 0.6 mm wide of white void grade 5: from 0.6 to 0.8 mm wide of white void grade 4: from 0.8 to 1.0 mm wide of white void grade 3: from 1.0 to 1.2 mm wide of white void grade 2: from 1.2 to 1.4 mm wide of white void grade 1: more than 1.4 mm wide of white void 4. Blank at trailing end of halftone area; copies were made with abovedescribed conditions using 10 pattern charts (every 3×30 cm) which have images being different in optical density by every 0.1 degree by every one image thereof, in the range of the density from 0.2 to 1.2, study was conducted with the uppermost optical density yielding blank at trailing end of halftone area(using 10 times of magnifying glass), indicating that the lower the density, the better the result appears.
5. Cutoffs of horizontal line: Copies for samples were produced using original chart of 50 μm×1 cm large to study deviation in width of line and cutoffs(unattached-toner portions), and resultant were compared with the ten steps standard, indicating as follow, grade 10 representing the best result.
6. Thickening of vertical line: Copies for samples were produced using original chart of 50 μm×1 cm large, average value of reproduced line widths were represented. Value 1.0 is the best result, degrading as the width is increased.
7. Sharpness of character (thickened in vertical and thinned in horizontal): measured in ten grades using the ten steps standard, grade 10 representing the best result.
8. Carrier deposition: degree of carrier deposition measured in ten grades over an image of two dot line (100 lpi/inch) developed along the sub scanning direction and loaded with a DC bias of 400 V, grade 10 representing the best result.

Evaluation of the carrier deposition was made by counting the number of carrier particles attached at the background area(non-image area) between two lines, calculating a number of attached carrier particles/100 $cm^2$. Resultant were represented as below, where grade 10 representing the best result.

grade 10: 0 carrier particles grade 9: less than 10 carrier particles grade 8: from 11 to 20 carrier particles grade 7: from 21 to 30 carrier particles grade 6: from 31 to 50 carrier particles grade 5: from 51 to 100 carrier particles grade 4: from 101 to 300 carrier particles grade 3: from 301 to 600 carrier particles grade 2: from 601 to 1000 carrier particles grade 1: more than 1000 carrier particles 9Brushing trace: brushing trace was measured in ten grades over a solid region loaded at 350 V of the developing bias, grade 10 representing the best result. The brushing trace was noticed in solid black area and measured in ten grades using the ten steps standard, grade 10 representing the best result.

Example 1

Carrier A(100 parts) and toner I(3.5 parts) were mixed and milled by a ball mill for 20 minutes to prepare a developer where the toner charge per mass was 37 μc/g.

The bulk density ρa of the developer was measured as 1.95 g/$cm^3$.

Then, the quality of the images developed using a remodeled Imagio MF4570 copy machine/digital printer was evaluated.

Involved conditions were linear speed of 230 mm/sec of photosensitive member, developing electric potential of 450 V (200 V in case of halftone image), background potential of 350 V, post-exposure potential of 150 V; the ratio of (linear speed of the developing sleeve/linear speed of the photosensitive member)=2.5, developing gap of 0.40 mm, amount of scooped up feed of 0.048 g/$cm^2$, density of the GP agent of 1.20 g/$cm^3$, and ρa(density of the GP agent )=J/Gp (g/$cm^3$)=0.62.

The results of the image quality were 1.46 in the optical density of the image, grade 9 in the smear of the background, grade 8 in the trailing end solid blank, 0.4 in the optical density level for causing blank at the trailing end of halftone image, grade 8 in the horizontal line cutoff, 1.15 in the vertical line thickening, grade 8 in the character sharpness, grade 7 in the carrier deposition, and grade 8 in tie brushing trace. As apparent, the image quality was good enough to have no undesired artifacts pertinent to the image density, tie smear of the background, and the developing direction.

Comparative Example 1

The developing action was carried out under the same conditions as of Example 1 except that modified were made the scooped up feed to 0.072 g/$cm^2$, the density of the GP agent to 1.80 g/$cm^3$, and the ρa(density of GP agent )=J/Gp (g/$cm^3$) to 0.92. Then, the image quality was evaluated.

It was found that the results of Comparative Example 1 for the blank at trailing end of solid area, at trailing end of halftone image, the cutoffs of horizontal line, the thickening in vertical line, the sharpness of character, and the brushing trace attributed to the developing direction were less favorable than those of Example 1.

While the developing conditions are listed in Table 1, the results of the image quality evaluation are shown in Table 2.

Comparative Example 2

The developing action was cared out under the same conditions as of Example 1 except that the carrier B was used. Then, the image quality was evaluated. As apparent firm Table 2, this Comparative Example 2 is less favorable than Example 1 in the smear of the background, the blank at trailing end of solid image area, the blank at trailing end of halftone image, the cutoffs at horizontal line, and the sharpness of character.

Comparative Example 3

The developing action was carried out under the same conditions as of Example 1 except that the carrier C (including carrier particles of smaller than 22 μm) was used. The results of the smear of the background, the sharpness of character, and the carrier deposition are less favorable than those of Example 1.

Comparative Example 4

The developing action was carried out under the same conditions as of Example 1 except that the carrier B was used. The results of the undesired artifacts pertinent to the developing direction including the smear of the background are generally less favorable than those of Example 1.

Example 2

The developing action was carried out under the same conditions as of Example 1 except that the crier core material E was used and the image quality was evaluated.

As a result, the margin for carrier deposition is improved when the magnetic moment of the carrier was made to 80 emu/g while the thickening of the vertical line was improved.

Example 3

The same developing action as of Example 1 was carried out and evaluated except that the developing electric potential was 320 V to reduce the charged potential to 130 V. As apparent, the image density remained favorable even if the developing potential was decreased to 130 V In particular, the thickening vertical line and the sharpness of character exhibited favorable results.

Example 4

The same developing action as of Example 1 was carried out and evaluated except that the potential of background area was 230 V to reduce the charged potential to 120 V. As a result, the blank at trailing end of halftone image was significantly avoided The above results are shown in Tables 1 and 2. Table 1 lists the developing conditions and the properties of the developer while Table 2 details the results of the image quality evaluation.

TABLE 1-1

| | Gp | J | ρp | ρa | ρp/ρa |
|---|---|---|---|---|---|
| Ex. 1 | 0.40 | 0.048 | 1.200 | 1.95 | 0.62 |
| Com. Ex. 1 | 0.40 | 0.072 | 1.800 | 1.95 | 0.92 |
| Com. Ex. 2 | 0.40 | 0.048 | 1.200 | 1.95 | 0.62 |
| Com. Ex. 3 | 0.40 | 0.048 | 1.200 | 1.95 | 0.62 |
| Com. Ex. 4 | 0.40 | 0.048 | 1.200 | 1.95 | 0.62 |
| Ex. 2 | 0.40 | 0.048 | 1.200 | 1.95 | 0.62 |
| Ex. 3 | 0.40 | 0.048 | 1.200 | 1.95 | 0.62 |
| Ex. 4 | 0.40 | 0.048 | 1.200 | 1.95 | 0.62 |
| Identical Claims | | | | | |

Gp: developing gap (cm), J: scooped up feed (g/cm$^2$), ρp (density of the GP agent) by J/Gp (g/cm$^3$), and ρa: bulk density of the developer (g/cm$^3$).

TABLE 1-2

| | carrier | Carrier core material | weight average particle diameter (μm) | number average particle diameter (μm) | percent by weight of 22-μm to 44-μm particles | percent by weight of particles smaller than 22 μm | Dv/Dp |
|---|---|---|---|---|---|---|---|
| Ex. 1 | A | 1 | 36.3 | 29.3 | 81.7 | 2.6 | 1.24 |
| Com. Ex. 1 | A | 1 | 36.3 | 29.3 | 81.7 | 2.6 | 1.24 |
| Com. Ex. 2 | B | 2 | 41.4 | 33.7 | 61.4 | 4.3 | 1.23 |
| Com. Ex. 3 | C | 3 | 34.3 | 27.4 | 85.2 | 8.1 | 1.25 |
| Com. Ex. 4 | D | 4 | 35.3 | 22.3 | 83.1 | 6.3 | 1.58 |
| Ex. 2 | E | 5 | 35.6 | 29.4 | 89.2 | 2.0 | 1.21 |
| Ex. 3 | A | 1 | 36.3 | 29.3 | 81.7 | 2.6 | 1.24 |
| Ex. 4 | A | 1 | 36.3 | 29.3 | 81.7 | 2.6 | 1.24 |
| Identical claims | | | | claim 1 | | | |

Core material 2: Cu—Zn ferrite
Core material 3: Cu—Zn ferrite
Core material 4: Cu—Zn ferrite
Core material 5: Mn ferrite

TABLE 1-3

| | carrier magnetic moment | toner charge per mass (μc/g, coated 50%) | developing potential | electric potential equal to $V_B$-$V_D$ |
|---|---|---|---|---|
| Ex. 1 | 50 | 37 | 450 | 350 |
| Com. Ex. 1 | 50 | 37 | 450 | 350 |
| Com. Ex. 2 | 50 | 37 | 450 | 350 |
| Com. Ex. 3 | 49 | 38 | 450 | 350 |
| Com. Ex. 4 | 51 | 37 | 450 | 350 |
| Ex. 2 | 80 | 36 | 450 | 350 |
| Ex. 3 | 50 | 37 | 320 | 350 |
| Ex. 4 | 50 | 37 | 450 | 230 |
| Identical Claims | Claim 2 | | claim 3 | claim 4 |

Magnetic momemt (emu/g): level of the magnetic moment at 1 KOe
Toner charge per mass: charge (μc/g) on the toner I coated 50%
Developing potential: $V_L$-$V_B$ (volt)
Electric potential: $V_B$-$V_D$ (volt)

TABLE 2-1

| | quality evaluation items | | | | |
|---|---|---|---|---|---|
| | ID | smear of the background | trailing end solid blank | trailing end half-tone blank | cutout of the horizontal line |
| Ex. 1 | 1.46 | 9 | 8 | 0.4 | 8 |
| Com. Ex. 1 | 1.41 | 8 | 5 | 1.0 | 5 |
| Com. Ex. 2 | 1.37 | 7 | 6 | 0.7 | 6 |
| Com. Ex. 3 | 1.37 | 6 | 7 | 0.5 | 8 |
| Com. Ex. 4 | 1.42 | 7 | 7 | 0.6 | 7 |
| Ex. 2 | 1.43 | 9 | 8 | 0.3 | 9 |
| Ex. 3 | 1.45 | 9 | 9 | 0.3 | 8 |
| Ex. 4 | 1.47 | 8 | 9 | 0.3 | 9 |

TABLE 2-2

| | quality evaluation items | | | | |
|---|---|---|---|---|---|
| | thickening of the vertical line | character sharpness | carrier deposition | brushing trace | remarks |
| Ex. 1 | 1.15 | 8 | 7 | 8 | claim 1 |
| Com. Ex. 1 | 1.43 | 5 | 7 | 6 | claim 1 |
| Com. Ex. 2 | 1.18 | 7 | 8 | 7 | claim 1 |
| Com. Ex. 3 | 1.48 | 6 | 3 | 8 | claim 1 |
| Com. Ex. 4 | 1.22 | 6 | 4 | 7 | claim 1 |
| Ex. 2 | 1.09 | 8 | 9 | 8 | claim 2 |
| Ex. 3 | 1.12 | 8 | 9 | 8 | claim 3 |
| Ex. 4 | 1.19 | 8 | 9 | 8 | claim 4 |

Advantages of the Invention

As apparent from the above detailed and specified description, the developing method of the present invention of a two component developer type having the linear speed ratio between the speed (Vp) of the photo-sensitive body and the speed (Vr) of the developing sleeve expressed as $1.2<Vr/Vp)<3$ and using a biased direct-current ($V_B$) to be applied is characterized in that the distance (Gp, a developing gap) at the nearest point between the photo-sensitive body and the developing sleeve is not greater than 0.6 mm and the density of the GP agent is controllably determined. Also, the carrier core material ranges from 25 $\mu$m to 45 $\mu$m in the weight average particle diameter. In particular, the particles of the carrier are made of small-diameter core materials protected with a resin coating. The carrier particles of smaller than 44 $\mu$m are not lower than 70 percent by weight and the particles of smaller than 22 $\mu$m are not higher than 7 percent by weight and the ratio between the weight average particle diameter Dv and the number average particle diameter Dp is $1 \leqq (Dv/Dp) \leqq 1.30$. Accordingly, as the developing method permits the magnetic moment of the crier, the developing potential, and the potential of background area to be favorably controlled, the undesired artifacts in each developed image pertinent to the orientation of the development can successfully be eliminated.

More specifically, the quality of resultant developed images can be improved as 1. the end blank is hardly generated, 2. the cutout of each horizontal line hardly occur, 3. the thickening of each vertical line is improved, 4. the sharpness of each character (thickened in vertical and thinned in horizontal) is improved, 5. the margin for carrier deposition is increased, and 6. the smear of the background is minimized.

What is claimed is:

1. A method of developing a latent electrostatic image using a two-component developer system, having a ratio (Vr/Vp) ranges $1.2<(Vr/Vp)<3$ where the (Vp) is a linear speed (Vp)[m/sec] of a photosensitive member and the (Vr) is a linear speed (Vr)[msec] of a developing sleeve, and applying a biased direct-current ($V_B$)[by volt], wherein; a developing gap(Gp)[cm ] as a distance at the nearest point between a photosensitive member and a developing sleeve is less than or equal to 0.6 mm, a ratio($\rho p/\rho a$) satisfies an expression $(\rho p/\rho a)<0.7$ where the $\rho p$ is a density[g/cm$^3$] of a developer at the nearest point between a photosensitive member and a developing sleeve, which is represented by an equation $\rho p=J/Gp$ where J is an amount of developer scooped up (the $\rho p$ is also expressed as "the density of the developer" or "the density of GP agent" in the specification) and the $\rho a$ is a bulk density[g/cm$^3$] of the developer, a carrier for electrophotography is used, the carrier is made of a carrier core particles having a weight average particle diameter(Dv) ranging from 25 $\mu$m to 45 $\mu$m, the particles of smaller than 44 $\mu$m are more than or equal to 70 percent by weight, the particles of smaller than 22 $\mu$m are less than or equal to 7 percent by weight, a ratio (Dv/Dp) between the weight average particle diameter (Dv )and the number average particle diameter(Dp) satisfies an expression $1 \leqq (Dv/Dp) \leqq 1.30$, the core particles are used by coated form with a resin material.

2. A method of developing a latent electrostatic image using a two-component developer system according to claim 1, wherein; the core carriers have a magnetic moment (at one kilo Oe) ranging 60 to 100 emu/g.

3. A method of developing a latent electrostatic image using a two-component developer system according to claim 1, wherein; a developing potential less than or equal to 350 volts is applied where the developing potential is defined by an expression ($V_L-V_B$) while the $V_L$ is a post-exposure potential and the $V_B$ is a biased direct-current potential.

4. A method of developing a latent electrostatic age using a two-component developer system according to claim 1, wherein; a potential of background area is less than or equal to 250 volts where the potential of background area defined by a expression ($V_B-V_D$) while the $V_B$ is a biased direct-current potential and the $V_D$ is a charged potential.

5. The method of claim 1, wherein said developing gap (Gp) is less than or equal to 0.5 mm.

6. The method of claim 1, wherein the core criers have a magnetic moment (at one kilo Oe) ranging from 40 to 130 emu/g.

7. The method of claim 1, wherein the core carriers are ferromagnetic materials selected from the group consisting of $MOFe_2O_3$ and $MFe_2O_4$, wherein M is a bivalent or monovalent metal ion selected from the group consisting of Mn, Fe, Ni, Co, Cu, Mg, Zn, Cd, Li and combinations thereof.

8. The method of claim 7, wherein the core carriers are a material selected from the group consisting of Li ferrite, Mn ferrite, Mn—Zn ferrite, Cu—Zn ferrite, Ni—Zn ferrite and Ba ferrite.

9. The method of claim 1, wherein the core particles have the resin material coated thereon at a thickness of from 0.02 to 1.0 $\mu$m.

10. The method of claim 9, wherein the core particles have the resin material coated thereon at a thickness of from 0.03 to 0.8 $\mu$m.

* * * * *